US006216720B1

(12) United States Patent
Evans, Jr. et al.

(10) Patent No.: US 6,216,720 B1
(45) Date of Patent: Apr. 17, 2001

(54) SIPHON ADAPTER

(75) Inventors: Raymond Douglas Evans, Jr., Everett; Matthew James Huff, Juniata, both of PA (US)

(73) Assignee: New Pig Corporation, Tipton, PA (US)

( * ) Notice: Subject to any disclaimer, the term of this patent is extended or adjusted under 35 U.S.C. 154(b) by 0 days.

(21) Appl. No.: 09/351,891

(22) Filed: Jul. 13, 1999

(51) Int. Cl.[7] ..... F04F 10/00

(52) U.S. Cl. ..... 137/142; 137/152; 137/577; 137/591; 222/416

(58) Field of Search ..... 137/142, 152, 137/591, 577; 222/416, 464.1

(56) References Cited

U.S. PATENT DOCUMENTS

| | | | | |
|---|---|---|---|---|
| 238,136 | | 2/1881 | Manwaring . | |
| 245,839 | * | 8/1881 | Karcheski | 137/152 |
| 466,336 | * | 1/1892 | Franklin | 137/577 X |
| 498,863 | | 6/1893 | Stallings . | |
| 580,437 | * | 4/1897 | Wagner | 137/577 X |
| 1,267,734 | | 5/1918 | Anderson . | |
| 1,287,046 | * | 12/1918 | Knapp | 222/416 |
| 1,573,291 | | 2/1926 | Bianchi . | |
| 1,938,174 | * | 12/1933 | Davis | 222/464.1 X |
| 1,953,525 | | 4/1934 | Young . | |
| 2,000,087 | | 5/1935 | Meeker et al. . | |
| 2,164,789 | | 7/1939 | Sheldon . | |
| 2,638,222 | * | 5/1953 | Roach | 137/577 |
| 2,741,404 | * | 4/1956 | Burton | 222/464.1 X |
| 3,245,583 | * | 4/1966 | Miller et al. | 222/464.1 X |
| 3,578,219 | * | 5/1971 | Berry | 222/464.1 X |
| 4,184,511 | * | 1/1980 | Wilson | 137/152 X |
| 4,237,928 | * | 12/1980 | Messersmith | 137/152 X |
| 4,630,759 | * | 12/1986 | Dawn | 111/464.1 X |
| 4,896,800 | * | 1/1990 | Corey | 222/416 |
| 5,333,639 | | 8/1994 | Nelson . | |
| 5,402,909 | | 4/1995 | Cramer et al. . | |

* cited by examiner

*Primary Examiner*—Gerald A. Michalsky
(74) *Attorney, Agent, or Firm*—Buchanan Ingersoll, P.C.

(57) ABSTRACT

A siphon adapter is disclosed. The siphon adapter is comprised of a pipe configured so that one end of the pipe fits inside of a container through the opening and is in very close proximity with the lowest portion of container. The other end of the pipe is outside the container and connected to a shut-off device. It is lower than the first end so that after liquid starts to flow out of the container through the pipe and the shut-off device, the pipe forms a siphon and the liquid continues to flow out of the container even after the level of the liquid is below the opening until substantially all of the liquid has flowed out of the container or the shut-off device is turned off.

22 Claims, 5 Drawing Sheets

SIPHON ADAPTER

BACKGROUND OF THE INVENTION

1. Field of the Invention

This invention relates to a siphon adapter that when used with a shut-off device (like a faucet) can aid in removing liquid from containers that would, without this invention, normally be left in the container and wasted.

2. Description of the Prior Art

This invention relates to containers where the drain hole is located higher than the bottom of the container and the container is situated so that there is clearance below the bottom of the container to allow for the use of the invention. The main application is with metal or plastic drums used in industry to transport, store and dispense liquids. The most typical drum sizes are 55 U.S. gallons and 30 U.S. gallons. However, this invention could be used on any size drum.

In most industrial settings, many different liquids are used on a regular basis. Dispensing liquids from drums can be done in a vertical or horizontal position. To dispense liquids in a vertical position, one of the bung plugs needs to be removed and replaced with a pump which reaches to the bottom of the drum. The liquid is then removed as needed until there is very little liquid remaining in the drum.

Horizontal dispensing is preferred because the drums can be stored on racks in a much more space-efficient manner. To dispense liquids in a horizontal position, a faucet and a vent are installed in the bungholes while the drum is vertical. The drum is then placed in its horizontal position on a rack. Because the bunghole is located in from the edge of the drum, the liquid will stop flowing when the liquid reaches the lower edge of the bunghole. Typically, approximately two U.S. gallons of the liquid remain in the drum.

The current solutions for trying to remove the remaining liquid are: while still in the rack, manually raising the backside of the drum (if it is accessible), or to manually pull the drum out of the rack somewhat to let it hang down in the front. Both of these methods could be dangerous to employees and still result in residual liquid remaining in the drum. The remaining liquid is valuable and it typically is discarded with the drums when they are recycled or scrapped. Therefore there is a longfelt need to easily, cheaply and safely remove a greater percentage of liquid from a drum laying in a horizontal position. Further, recent government regulations require that all but 3% of the liquid in a drum must be removed.

SUMMARY OF THE INVENTION

We provide a siphon adapter comprised of a hollow pipe having two ends. The first end is configured to fit through the opening of a container where the opening is higher than the bottom of the container. The first end is positioned and can be adjusted so that the opening of the pipe is very near and substantially parallel to the bottom of the container. The second end of the pipe remains outside the container and is lower than the first end. A faucet or other shut-off device is connected to the second end of the pipe. The shut-off device may have an open position and a closed position. When the shut-off device is in the open position, the liquid in the container flows out of the container through the pipe and the shut-off device. When the shut-off device is in the closed position, no liquid can flow out of the container and an airtight seal is formed by the shut-off device. In order for the pipe to act as a siphon, the level of liquid initially has to be above the opening. After the shut-off device is opened, the pipe fills with liquid and the liquid begins to exit the container. Therefore, the pipe acts as a siphon and liquid continues to exit the container through the pipe and the shut-off device even after the level of liquid is lower than the opening, until substantially all the liquid has exited the container or the shut-off device is in the closed position. Because the shut-off device forms a seal and is lower than the liquid level, if it is placed in an open position after it has been closed, the pipe will again act as a siphon even if the level of the liquid was below the opening when the shut-off device was closed.

The pipe can be molded as one piece or can be made up of two or more pieces. The pipe can be configured for attachment to the bunghole with a threaded connection. The first end of the pipe can be adjusted so that it is in substantially close proximity with the lowest side of the drum regardless of the distance between the bunghole and the side of the drum. There can be a slip joint sealing arrangement around the threaded connection that can be adjusted after the siphon adapter has been tightened in the bunghole. The siphon adapter can be sized so that it fits in a bunghole that has a diameter of two inches, three quarter inches or any size. The siphon adapter can be constructed primarily of metal, plastic or any other suitable material.

DESCRIPTION OF THE PREFERRED EMBODIMENTS

The siphon adapter can be used to empty any liquid containers where the drain hole is higher than the bottom of the container. However, our preferred embodiment is configured to be used to empty drums of liquids.

Figure 1:
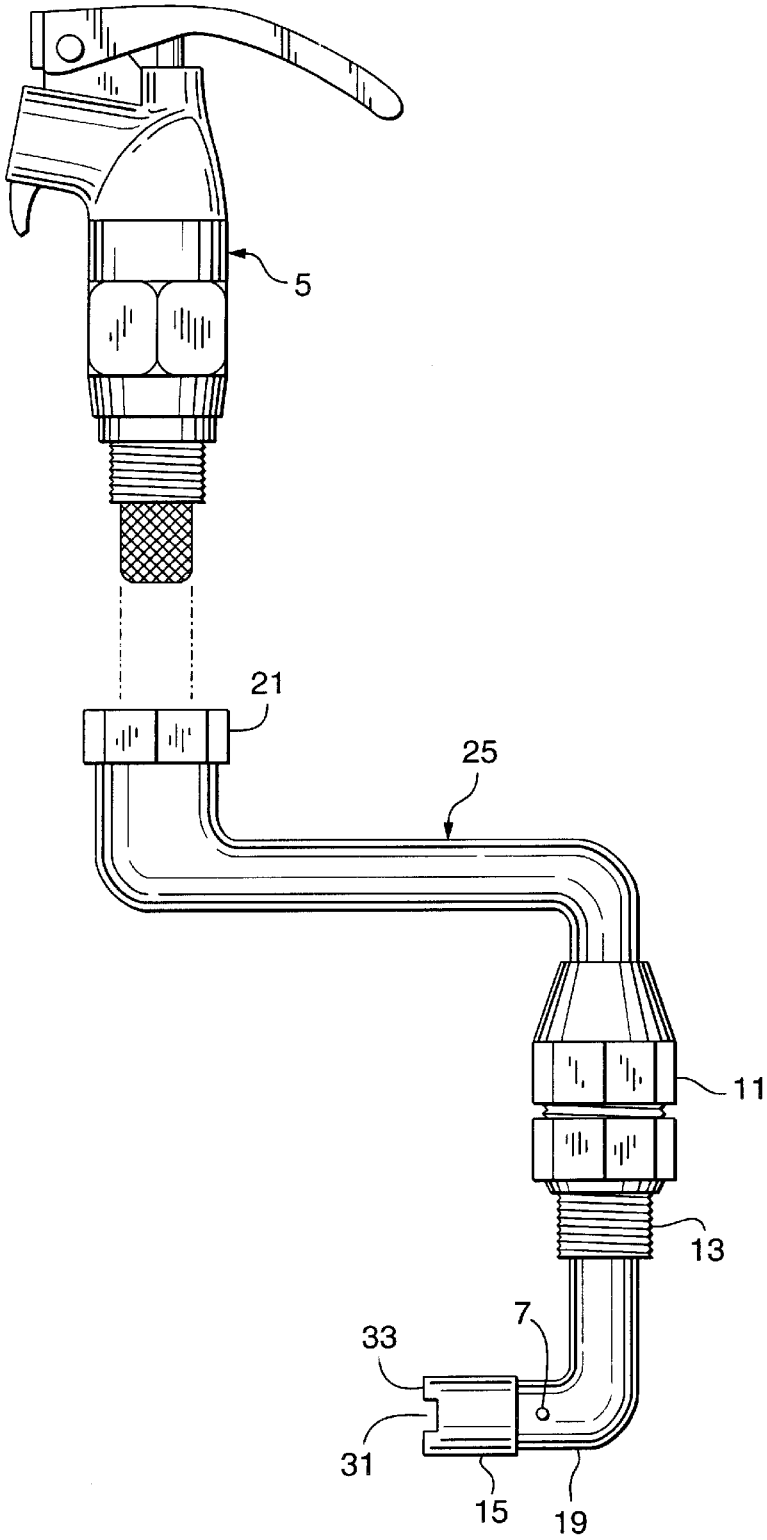
FIG. 1 is an exploded side view of the siphon adapter and faucet.
Figure 2:
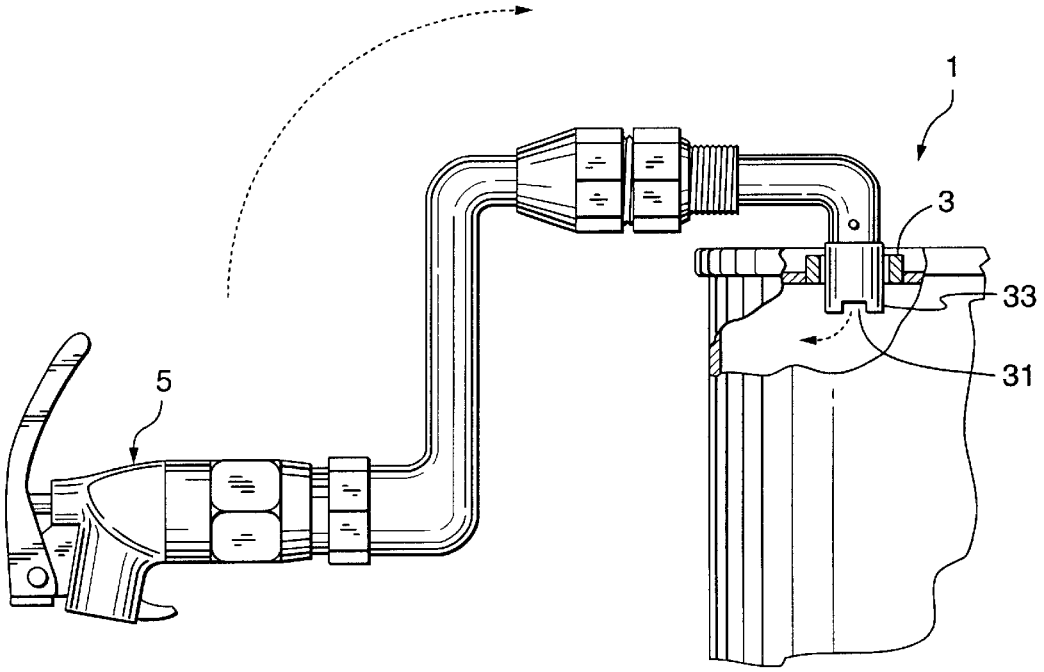
FIG. 2 is a side cut away view of the siphon adapter being inserted into a drum through the bunghole.
Figure 3:
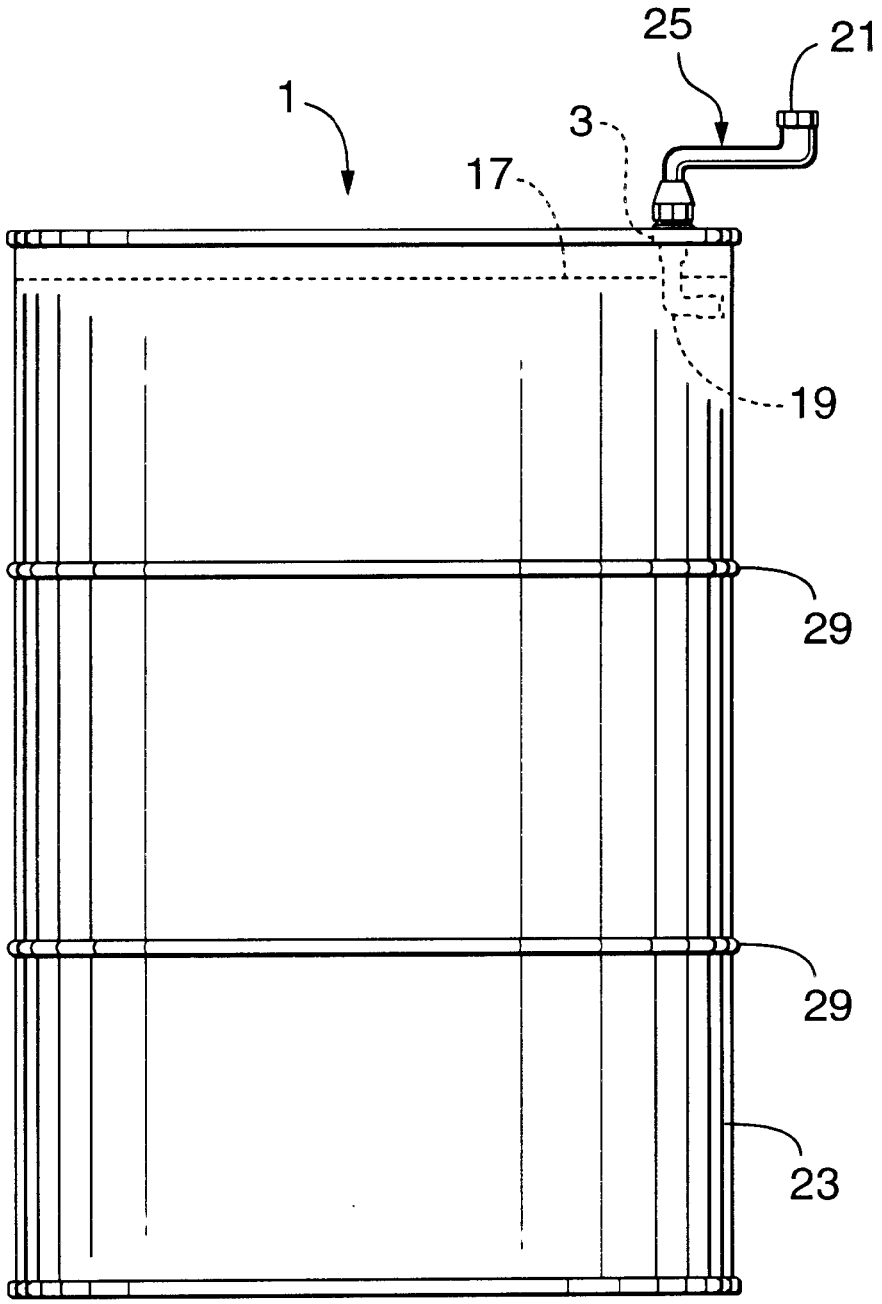
FIG. 3 is a side view of the siphon adapter showing how it is positioned in a vertical 55 gallon drum.
Figure 5:
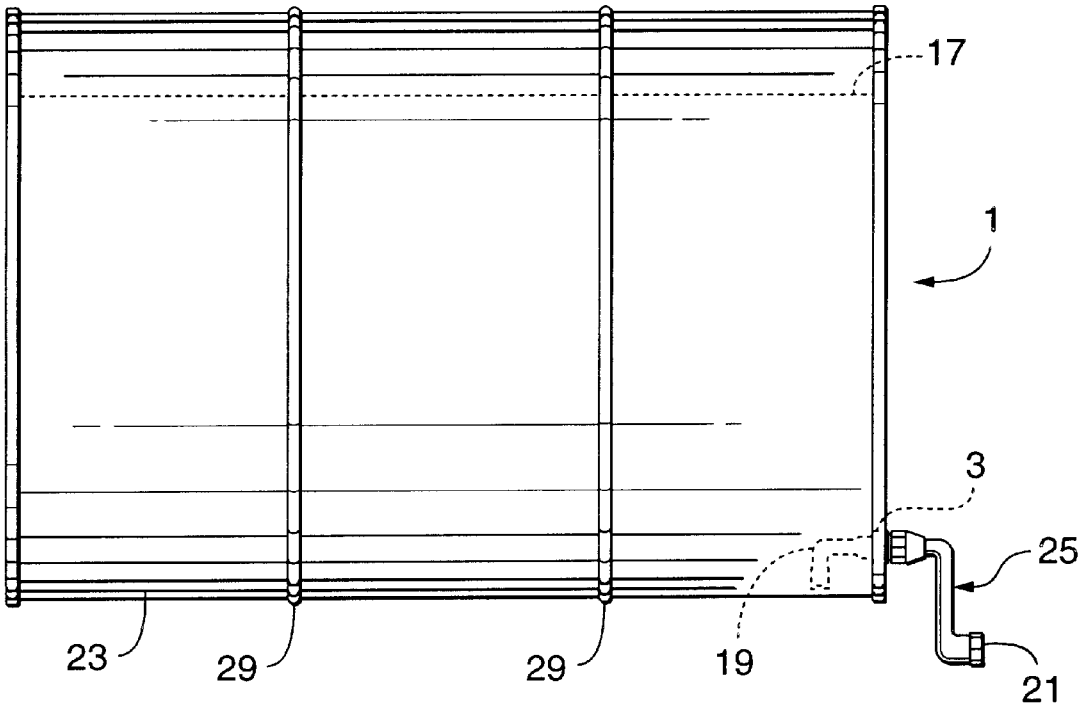
FIG. 5 is a side view of the siphon adapter in a horizontal 55 gallon drum.

In order to use the siphon adapter, shown in FIG. 1, the shut-off device, which is a faucet 5, should first be threaded on the second end 21 of the siphon adapter which comprises the siphon adapter 25. We prefer to use a faucet as the shut-off device. However, a ball valve or any other device that can restrict the flow of the liquid may be used. Next, while the drum is still in the vertical position, the bung plug should be removed from the bunghole. The first end 19 of the siphon adapter should be inserted into the drum 1 through the bunghole 3, as shown in FIG. 2; positioned so that the end 19 is touching the side 23 of the drum 1; and the opening of the siphon adapter 25 placed parallel to the side 23 of the drum 1, as shown in FIG. 3. Siphon adapter 25 should then be attached to the bunghole 3 with the threaded connection 13. The siphon adapter may be attached by several methods other than a threaded connection, such as, but not limited to, welding, glue or press fit. At this point, the drum may be laid on it side, as shown in FIG. 5, for dispensing, storage or transportation.

An optional slip joint sealing arrangement 11 allows for final tightening and alignment of the siphon adapter 25 even after the threaded connection 13 has been tightened in the bunghole. Different types of arrangements may be used in place of the slip joint sealing arrangement, including, but not limited to a flange arrangement.

Figure 4:
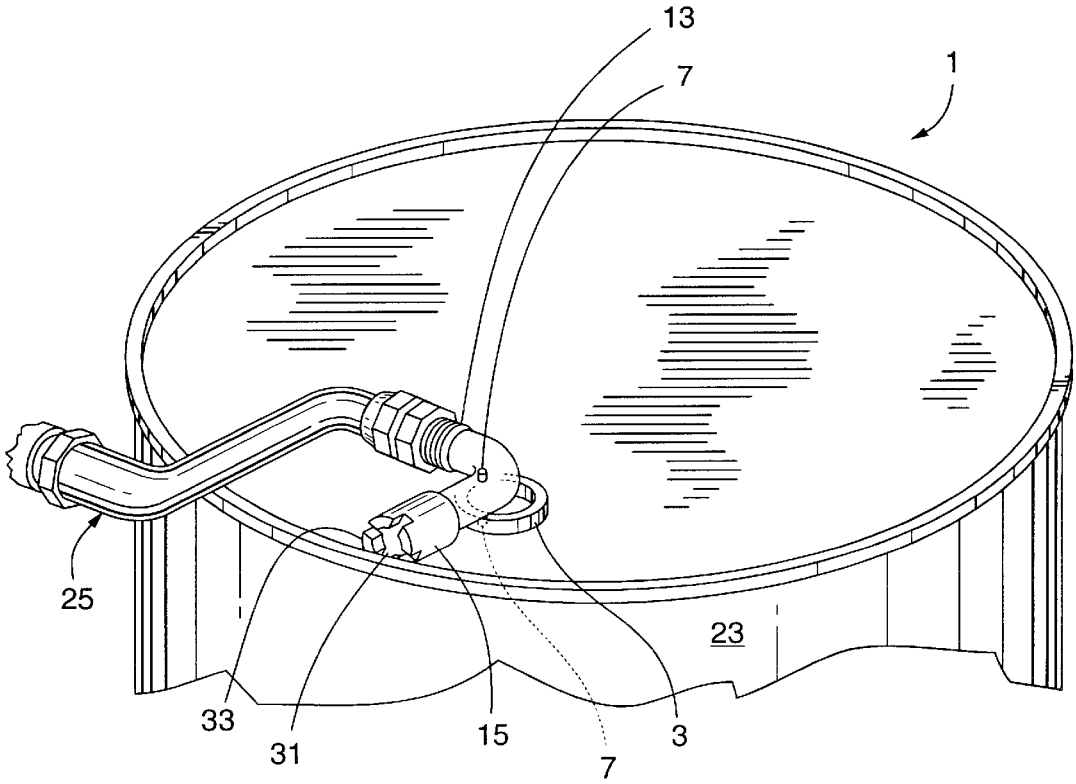
FIG. 4 is a front cut away view of the drum and first end of the siphon adapter with the adjusting collar.

The optional adjusting threaded collar 15 may need to be adjusted up or down to compensate for varying location of the bung 3. An optional protrusion 7 shown in FIG. 4 may be used to help adjust collar 15 of the siphon adapter before it is inserted into the drum. The siphon adapter 25 may be manufactured so that the protrusion 7, when resting against the lower edge of the bunghole 3 and when the first end 19 of the siphon adapter 25 is in the correct position as shown in FIG. 4, will allow the collar 15 to be adjusted by turning the collar counter-clockwise so that its points 33 are in close proximity to or touching the inside edge of drum 23. Alternatively, the collar may be adjusted by the process of inserting the siphon adapter 25 into the drum 1 to feel or hear if the collar touches the edge of the drum 23. If it doesn't, remove siphon adapter and adjust the collar. Repeat this process until the collar touches the edge of the drum. If the collar touches the drum and won't turn, remove the siphon adapter from the drum and try to install again. The collar 15 should slightly touch the side 23 of the drum for best performance.

In the preferred embodiment, the bottom of the threaded collar 15 has four apertures 31 positioned 90° apart so that there are four points 33 that scrape the bottom of the drum when the collar 15 is in the best position. The total area of the four apertures 31 are preferably greater than the smallest restriction in the faucet 5 or shut-off device. The larger the apertures 31 the less impedance there is on the flow of the liquid out of the drum 1. However, the siphon adapter 25 can only remove liquid down to the level of the top of the apertures 31. So if the apertures are large and high, liquid would flow out of the container quickly but there would be more liquid remaining in the container than if the apertures were smaller and lower. If there are no apertures, the siphon adapter could drain all the liquid out of the container except that lying in the ribs. However, the flow of the liquid out of the drum would be very slow. The apertures 31 and their configuration in the threaded collar 15 are optional. The invention may be implemented without them. The siphon adapter does not need either the collar 15 or the flange arrangement 11. However, it may have either the collar 15 or the flange arrangement 11 or both. The siphon adapter should be tightened securely and aligned in the bung 3.

The siphon is a natural one. It starts itself when the liquid level 17 in the drum is above the level of the bunghole and the faucet is in the open position. Gravity forces the liquid out of the drum when the faucet is opened. This flow, started by the force of gravity, initiates the siphon action which continues to drive a liquid out of the drum even after the level of the liquid is lower than the bunghole. If the siphon action is lost while the drum is being emptied, raise the opposite end of the drum until the siphon action is regained. If the product is installed correctly, the siphon action will not be lost unless the drum accidentally rolls. For best performance, proper alignment of the siphon adapter should be ensured. The drum 1 should be vented for best flow rate. Teflon tape may be applied to the threads if needed.

The preferred siphon adapter can be sized to fit a standard ¾ inch bunghole, a standard 2 inch bunghole or any size bunghole. The siphon adapter can be constructed primarily of plastic or metal and the siphon adapter can be rigid or flexible or both flexible and rigid in different places. It is removable and reusable or could be permanently mounted in any size container. The siphon adapter may be comprised of one or several pieces. When used to drain liquid from a drum, the siphon adapter allows all liquid except that lying in the rings 29 of the drum to flow out of the drum when dispensing the drum horizontally. It is not necessary that the drum be tilted.

Although I have shown a present preferred embodiment of our siphon adapter, it should be distinctly understood that the invention is not limited thereto but may be variously embodied within the scope of the following claims.

We claim:

1. A siphon adapter for removing liquid from a container having an opening and a bottom, the opening being higher than the bottom of the container, the siphon adapter comprising:

(a) a hollow, substantially rigid, U-shaped pipe having a first end and a second end, the pipe being configured so that the first end can fit through the opening of the container, the liquid being initially at a level above the opening, the first end being in a close proximity with the bottom of the container, the pipe being configured so that the second end remains outside of the container and is lower than the first end when the first end is inserted inside the container; and (b) a shut-off device connected to the second end, the shut-off device having an open position and a closed position so that when the shut-off device is in the closed position, no liquid flows out of the container through the pipe and shut-off device, and when the shut-off device is in the open position, the liquid in the container flows out of the container via gravitational forces through the pipe and the shut-off device so that the pipe acts as a siphon and liquid continues to exit the container through the pipe even after the level of the liquid is lower than the opening until substantially all liquid has exited the drum or the shut-off device is in the closed position, wherein the pipe is adjustable so that the first end can be in substantially close proximity with the bottom of the container regardless of the distance between the opening and the bottom of the container.

2. The siphon adapter of claim 1 further comprising an adjusting collar attached to the first end.

3. The siphon adapter of claim 2 further comprising means for facilitating adjustment of the adjusting collar to an appropriate position prior to insertion into the container.

4. The siphon adapter of claim 2 wherein the adjusting collar is threaded onto the first end of the pipe.

5. A siphon adapter for removing liquid from a generally horizontally positioned drum, said drum having a lowest side and a bunghole opening provided on an end thereof, the siphon adapter comprising:

(a) a hollow, substantially rigid, U-shaped pipe having a first end and a second end, the pipe being configured so that the first end can fit through the bunghole of the drum, the liquid being initially at a level above the bunghole, the first end of the pipe being in close proximity with the lowest side of the drum, the pipe being configured so that the second end remains outside of the drum and is lower than the first end when the first end is inserted inside the drum; and (b) a shut-off device connected to the second end, the shut-off device having an open position and a closed position so that when the shut-off device is in the closed position, no liquid flows out of the drum through the pipe and shut-off device, and when the shut-off device is in the open position, the liquid in the drum flows out of the drum via gravitational forces through the pipe and the shut-off device so that the pipe acts as a siphon and liquid continues to exit the drum through the pipe even after the level of the liquid is lower than the bunghole until substantially all liquid has exited the drum or the shut-off device is in the closed position, wherein the pipe is adjustable so that the first end can be in substantially close proximity with the lowest side of the drum regardless of the distance between the bunghole and the lowest side of the drum.

6. The siphon adapter in claim 5 wherein an airtight seal is formed by the shut-off device when the shut-off device is in the closed position so that when the shut-off device is returned to the open position the pipe will act as a siphon even if the level of the liquid was lower than the bunghole when the shut-off device was placed in the closed position.

7. The siphon adapter in claim 5 further comprising an adjusting collar attached to the first end.

8. The siphon adapter in claim 7 wherein the pipe is configured so that it can be attached with a threaded connection to the bunghole.

9. The siphon adapter in claim 8 further comprising a slip joint sealing arrangement around the threaded connection.

10. The siphon adapter in claim 8 wherein the slip joint sealing arrangement is configured so that the pipe can be adjusted after the pipe has been tightened in the bunghole.

11. The siphon adapter in claim 10 wherein the shut-off device is a faucet.

12. The siphon adapter of claim 11 wherein the pipe is configured so that the first end can fit through a bunghole having a diameter of approximately two inches.

13. The siphon adapter of claim 12 wherein the siphon adapter is constructed primarily of plastic or primarily of metal.

14. The siphon adapter of claim 11 wherein the pipe is configured so that the first end can fit through a bunghole having a diameter of approximately three-quarter inches.

15. The siphon adapter of claim 14 wherein the siphon adapter is constructed primarily of plastic or primarily of metal.

16. The siphon adapter of claim 7 further comprising means for facilitating adjustment of the adjusting collar to an appropriate position prior to insertion into the drum.

17. The siphon adapter of claim 7 wherein the adjusting collar is threaded onto the first end of the pipe.

18. The siphon adapter of claim 7 wherein the adjusting collar has a plurality of apertures formed therein, wherein liquid in the drum enters the siphon adapter through the plurality of apertures.

19. The siphon adapter of claim 18, wherein the plurality of apertures have a total area greater than an area of smallest restriction in the shut-off device.

20. The siphon adapter of claim 5 wherein the siphon adapter is constructed primarily of plastic or primarily of metal.

21. A siphon adapter for removing liquid from a container having an opening and a bottom, the opening higher that the bottom of the container, the siphon adapter comprising:

(a) a hollow pipe having a first end and a second end, the pipe being configured so that the first end can fit through the opening of the container, the liquid being initially at a level above the opening, the first end being in a close proximity with the bottom of the container, the pipe being configured so that the second end remains outside of the container and is lower than the first end when the first end is inserted inside the container;

(b) a shut-off device connected to the second end, the shut-off device having an open position and a closed position so that when the shut-off device is in the closed position, no liquid flows out of the container through the pipe and shut-off device, and when the shut-off device is in the open position, the liquid in the container flows out of the container through the pipe and the shut-off device so that the pipe acts as a siphon and liquid continues to exit the container through the pipe even after the level of the liquid is lower than the opening until substantially all liquid has exited the drum or the shut-off device is in the closed position, wherein the pipe is adjustable so that the first end can be in substantially close proximity with the bottom of the container regardless of the distance between the opening and the bottom of the container;

(c) an adjusting collar attached to the first end; and (d) means for facilitating adjustment of the adjusting collar to an appropriate position prior to insertion into the container, wherein the means for facilitating adjustment comprises a protrusion extending from the pipe, the protrusion configured to rest against a lower edge of the opening to simulate positioning of the adjusting collar relative to the container bottom with the siphon adapter connected to the container, wherein the adjusting collar may be adjusted to the appropriate position in close proximity with the bottom of the container.

22. A siphon adapter for removing liquid from a generally horizontally positioned drum, said drum having a lowest side and a bunghole opening provided on an end thereof, the siphon adapter comprising:

(a) a hollow pipe having a first end and a second end, the pipe being configured so that the first end can fit through the bunghole of the drum, the liquid being initially at a level above the bunghole, the first end of the pipe being in close proximity with the lowest side of the drum, the pipe being configured so that the second end remains outside of the drum and is lower than the first end when the first end is inserted inside the drum;

(b) a shut-off device connected to the second end, the shut-off device having an open position and a closed position so that when the shut-off device is in the closed position, no liquid flows out of the drum through the pipe and shut-off device, and when the shut-off device is in the open position, the liquid in the drum flows out of the drum through the pipe and the shut-off device so that the pipe acts as a siphon and liquid continues to exit the drum through the pipe even after the level of the liquid is lower than the bunghole until substantially all liquid has exited the drum or the shut-off device is in the closed position, wherein the pipe is adjustable so that the first end can be in substantially close proximity with the lowest side of the drum regardless of the distance between the bunghole and the lowest side of the drum;

(c) an adjusting collar attached to the first end; and (d) means for facilitating adjustment of the adjusting collar to an appropriate position prior to insertion into the drum, wherein the means for facilitating adjustment comprises a protrusion extending from the pipe, the protrusion configured to rest against a lower edge of the bunghole to simulate positioning of the adjusting collar relative to the lowest side of the drum with the siphon adapter connected to the drum, wherein the adjusting collar may be adjusted to the appropriate position in close proximity with the lowest side of the drum.

* * * * *